US008430018B2

(12) United States Patent
Hohmann

(10) Patent No.: US 8,430,018 B2
(45) Date of Patent: Apr. 30, 2013

(54) DEVICE FOR COUPLING A PISTON TO AN ANNULAR DISK

(75) Inventor: Marc Hohmann, Niederwoellstadt (DE)

(73) Assignee: ixeric MAC GmbH, Bad Homburg v.g.H. (DE)

( * ) Notice: Subject to any disclaimer, the term of this patent is extended or adjusted under 35 U.S.C. 154(b) by 926 days.

(21) Appl. No.: 12/309,783

(22) PCT Filed: Jun. 19, 2007

(86) PCT No.: PCT/DE2007/001078

§ 371 (c)(1),
(2), (4) Date: Aug. 17, 2009

(87) PCT Pub. No.: WO2008/014737

PCT Pub. Date: Feb. 7, 2008

(65) Prior Publication Data

US 2009/0304530 A1 Dec. 10, 2009

(30) Foreign Application Priority Data

Jul. 29, 2006 (DE) ..... 10 2006 035 149

(51) Int. Cl.
*F04B 53/14* (2006.01)

(52) U.S. Cl.
USPC ..... 92/71

(58) Field of Classification Search ..... 92/12.2, 92/71; 417/269, 222.2
See application file for complete search history.

(56) References Cited

U.S. PATENT DOCUMENTS

| | | | | |
|---|---|---|---|---|
| 1,430,275 | A * | 9/1922 | Almen | 74/60 |
| 4,379,425 | A * | 4/1983 | Ishizuka | 92/71 |
| 5,181,453 | A * | 1/1993 | Kayukawa et al. | 92/12.2 |
| 5,201,261 | A * | 4/1993 | Kayukawa et al. | 92/71 |
| 5,228,841 | A * | 7/1993 | Kimura et al. | 92/12.2 |
| 5,380,167 | A * | 1/1995 | Burkett et al. | 92/71 |
| 5,387,091 | A * | 2/1995 | Kawaguchi et al. | 92/12.2 |
| 5,528,976 | A | 6/1996 | Ikeda et al. | |
| 6,164,252 | A | 12/2000 | Kuhn et al. | |
| 6,308,615 | B1 * | 10/2001 | Takenaka et al. | 92/71 |
| 6,582,200 | B2 * | 6/2003 | Kato et al. | 92/71 |
| 2001/0054352 | A1 * | 12/2001 | Sugiura et al. | 92/153 |
| 2003/0066419 | A1 * | 4/2003 | Kato et al. | 92/71 |

FOREIGN PATENT DOCUMENTS

| | | | |
|---|---|---|---|
| DE | 4441721 | C2 | 6/1995 |
| DE | 19749727 | C2 | 6/1999 |
| DE | 10010142 | C2 | 9/2001 |
| EP | 1074737 | A3 | 2/2001 |
| EP | 1167761 | A3 | 1/2002 |
| EP | 1172554 | A3 | 1/2002 |

* cited by examiner

*Primary Examiner* — Thomas E Lazo

(74) *Attorney, Agent, or Firm* — Davidson, Davidson & Kappel, LLC

(57) ABSTRACT

A device for coupling a piston to an annular disc, in particular to a captive C-washer/swash plate or to a pivot ring of the working unit of a reciprocating-piston machine, preferably of a compressor of the air-conditioning system of a motor vehicle, having a piston bridge which is assigned to the piston and sliding shoes which are assigned to the annular disc, wherein the piston bridge engages at least partially around or over the annular disc and is in sliding engagement with the annular disc by means of the sliding shoes, is characterized in that the piston bridge is of two-layer design at least on the side facing towards the piston. The invention also relates to a reciprocating-piston machine having a device according to the invention.

24 Claims, 2 Drawing Sheets

DEVICE FOR COUPLING A PISTON TO AN ANNULAR DISK

Figure 1:
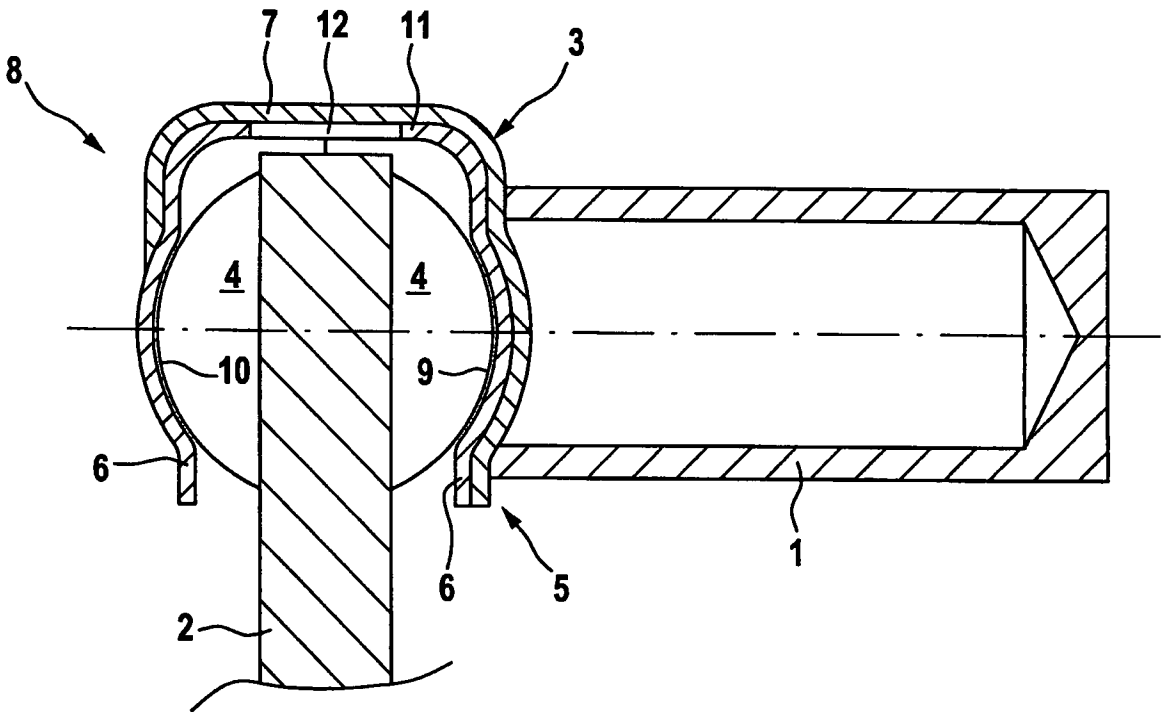

The present invention relates to a device for coupling a piston to an annular disk, in particular to a swash/wobble plate or to a swash ring of the power unit of a reciprocating piston machine, preferably of a compressor of the air-conditioning system of a motor vehicle, having a piston bridge assigned to the piston and sliding shoes acting between the annular disk and the piston bridge, the piston bridge at least partially embracing, respectively overlapping the annular disk and engaging slidingly via the sliding shoes with the annular disk.

BACKGROUND

The device of the species is typically used in reciprocating piston machines which have been known for many years in a wide variety of designs and for a wide variety of intended applications. A reciprocating piston machine of this kind may be a compressor, thus, for example, a compressor for the air conditioning system of a motor vehicle. Compressors of this kind are also usually referred to as air-conditioner compressors, and include a housing, which contains an externally driven compressor unit or pump unit. The compressor unit designed, for example, as an axial piston machine, includes, in turn, a plurality of pistons which are able to reciprocate within a cylinder block. In response to the rotation of a wobble plate mostly designed as an annular disk, or in response to the slewing motion of a corresponding swash plate, the pistons are reciprocated. The housing is typically closed.

Swash-plate compressors or swash-ring compressors are well known in a wide variety of designs. In this connection, reference is made merely exemplarily to the German Patent Application DE 44 41 721 A1, as well as to the German Patent DE 100 10 142 C2.

With respect to other design details, reference is made to the German Patent DE 197 49 727 C2.

In the case of the reciprocating piston machine known from the German Patent DE 197 49 727 C2, a circular, annular swash plate, also referred to as swash ring, is provided, whose inclination relative to the machine shaft is adjustable. The swash plate is driven to rotate by the machine shaft. This is accomplished via a sliding member that is axially guided on the machine shaft as well as via a driving pin that is configured at a distance from the machine shaft. The pistons have articulated connections with which the swash plate engages slidingly.

Specifically, the known reciprocating piston machine includes a power unit having a plurality of correspondingly driven pistons, the pistons being guided in cylinder bores and following the slewing/wobble motion of the annular disk via special coupling elements and executing their stroke in this manner.

The device of the species used in the known reciprocating piston machine is typically fabricated from relatively thick sheet metal which results directly in a considerable unit size in order to allow a large enough clearance space for the shoes and swash ring. Moreover, to enlarge the clearance space for the shoes and swash ring, it is not unusual for stamped formations to be required which outwardly displace the piston bridge material, thereby again enlarging the installation space, namely by radially enlarging the same. This is all completely diametrically counter to miniaturization, i.e., a reduction in installation space, that is always to be aspired to today.

SUMMARY OF THE INVENTION

It is, therefore, an object of the present invention to design and refine a device for coupling a piston to an annular disk, in particular to a swash/wobble plate or to a swash ring of the power unit of a reciprocating piston machine, preferably of a compressor of the air-conditioning system of a motor vehicle, in a way that will make it possible to realize a smallest possible installation space, while ensuring adequate strength and providing a large enough clearance space for the shoes and the swash ring. A further object is to provide a reciprocating piston machine equipped with such a device.

In accordance with the present invention, the device includes a piston bridge is designed to have two layers at least on the side facing the piston.

The present invention has recognized that thick sheet metals are not the only way to achieve a sufficient flexural strength. Rather, an adequate flexural strength is also attainable for the piston bridge by designing it to have two layers, at least on the side facing the piston, for example, on the pressure side, namely by using substantially thinner sheet-metal panels which, together, provide an adequate flexural strength.

By using at least two sheet-metal panels to realize a two-layer sliding shoe design, the further advantage may be derived that each of the sheet-metal panels is able to achieve substantially narrower bending radii, thereby providing a clearance space for the shoes and the swash ring that extends further within the interior of the sliding shoe. Moreover, outward formations, respectively stamped-out formations are able to be realized in the inner sheet-metal layer, thereby making it possible to routinely avoid a stamping process involving the outward displacement of material. An enlargement of the installation space may likewise be thereby avoided.

The piston bridge material may be advantageously realized as two-layer sheet metal, it also being perfectly conceivable to design the piston bridge using three- or multi-layer sheet metals, and, in fact, in accordance with the specific requirements.

Specifically, the piston bridge may include an inner shell and an outer shell, it being possible for one or more intermediate shells to be provided between the inner shell and the outer shell. The intermediate shells, in turn, may be designed as partial shells or as complete shells. By employing suitable structural design measures, the individual regions of the piston bridge may be formed with different thicknesses, and with different outward formations, recesses, stamped-out formations, etc.

The outer shell extends in an especially advantageous manner from the side facing the piston, i.e., from the piston, by way of a side surface up to or over the side of the piston bridge facing away from the piston. Such a design has the significant advantage that the piston bridge on the pressure side, for example, on the side facing the piston, is designed to have at least two layers. On the suction side, for example, on the side facing oppositely to, respectively away from the piston, a single-layer design of the piston bridge suffices, thereby making it possible to reduce the weight of the piston bridge.

Moreover, it is possible that the inner shell and, as the case may be, the outer shell be provided on opposite sides with outwardly stamped or bent regions of a pressure cup (on the side facing the piston) and of a suction cup (on the side facing away from the piston), which are used for accommodating the sliding shoes. The interaction of the pressure and suction cups with the sliding shoes renders possible an ideal articulated connection, the pistons engaging with the swash plate via the articulated connections.

It was already previously indicated that the region of the suction cup, for example, the suction side of the sliding shoe, may have a single-layer design, the suction cup preferably being formed by the inner shell.

Moreover, it is conceivable for the inner shell to be provided, preferably in one side surface, with a recess, preferably a stamped-out formation, which enlarges the space within the piston bridge and thus the clearance space for the annular disk and/or the sliding shoes by the wall thickness of the inner shell. A significant advantage of this measure is that the need for stamping the entire piston bridge, which entails an outward material displacement, is eliminated, thereby substantially avoiding an unwanted enlargement of the installation space in the radial direction.

The two or more shells may be configured to virtually engage positively with one another. It is also conceivable in this context for a type of non-positive force-locked connection to be realized between the two shells, so that the shells are mechanically interconnected due to a material-specific prestressing. It is alternatively or additionally conceivable for the shells to be joined to one another using bonding techniques or by rivets.

In an especially advantageous manner, the shells are joined to one another by welding. To facilitate a welded connection of this kind, in particular to facilitate the connection produced by resistance welding, at least one of the shells to be joined, preferably the inner shell, has punctiform or linear raised parts, preferably produced using stamping techniques, which facilitate the resistance welding relative to the opposite shell. The space formed in the process between the shells allows a stamping of the inner shell to extend further, thereby enlarging the space within the piston bridge and thus enlarging the clearance space for the shoes and/or the swash ring.

It is also noted that the piston bridge may be welded via its outer shell to the piston, any other conceivable joining technique being possible. The piston may be designed as a hollow body in the sense of a sleeve that is closed at the extremity, the outer shell of the piston bridge being suited for sealing the sleeve that forms the piston.

The teaching of the present invention may be advantageously embodied and refined in various ways. The following description of two preferred exemplary embodiments of the present invention are provided in the drawing. In conjunction with the explanation of the preferred exemplary embodiments of the present invention which make reference to the drawing, generally preferred embodiments and refinements of the teaching are also elucidated. In the drawing, FIG. 1 shows, in a schematic, cross-sectional view, an exemplary embodiment of a device according to the present invention including a piston having a piston bridge; and FIG. 2 shows, in a schematic, cross-sectional view, a second exemplary embodiment of a piston bridge having mutually spaced apart shells.

DETAILED DESCRIPTION

Figure 2:
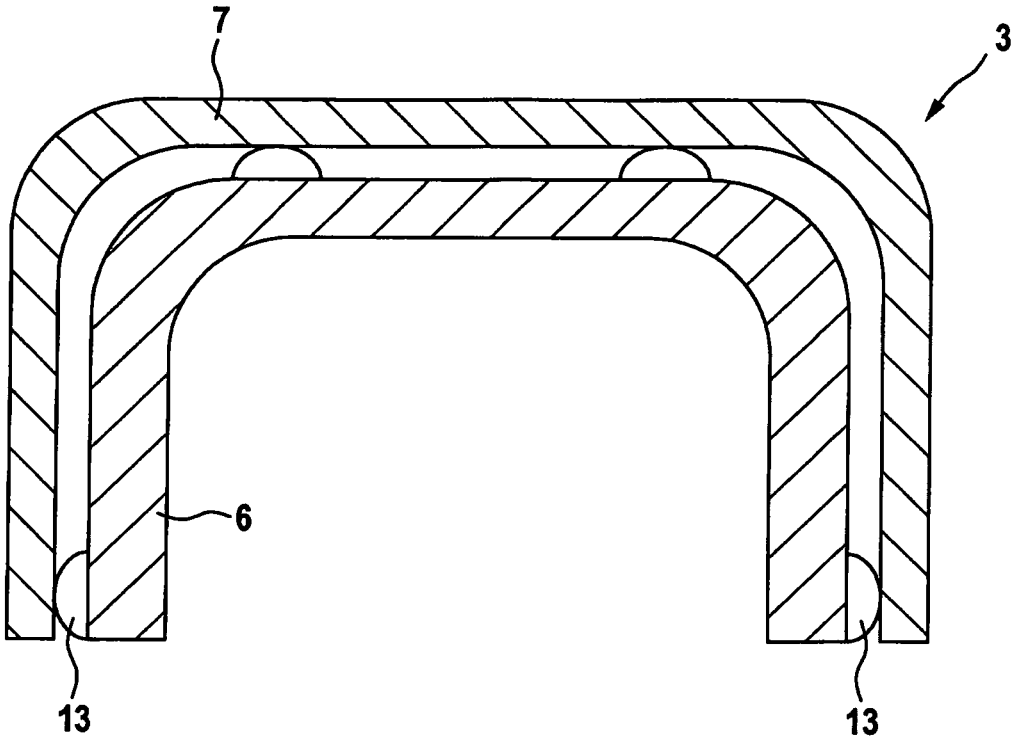

FIG. 1 shows an exemplary embodiment of a device according to the present invention for coupling a piston 1 to an annular disk 2 (indicated merely schematically in the figure) of the power unit of a reciprocating piston machine. With regard to the features of a reciprocating piston machine, reference is made specifically to the German Patent DE 197 49 727 C2 already mentioned at the outset, in particular to its FIGS. 1 and 2, together with the corresponding description. For the sake of a simpler description, a complete reciprocating piston machine is not depicted here, especially as what is concerned is the device for coupling a piston to a corresponding annular disk.

FIG. 1 indicates that piston 1 engages slidingly with annular disk 2, a piston bridge 3 being assigned to piston 1. Sliding shoes 4 act between annular disk 2 and piston bridge 3, piston bridge 3 embracing, respectively overlapping annular disk 2, piston 1 engaging slidingly via sliding shoes 4 and piston bridge 3 with annular disk 2.

In accordance with the present invention, piston bridge 3 is designed to have two layers, at least on the side facing piston 1, for example, on pressure side 5.

Specifically, in the exemplary embodiment shown in FIG. 1, the material of piston bridge 3 is realized as two-layer sheet metal, piston bridge 3 including an inner shell 6 and an outer shell 7.

Also discernible in FIG. 1 is that outer shell 7 extends from the side facing piston 1 over a side surface 11 up to the edge of the opposite side, for example, up to the edge of suction side 8. Thus, on the less stressed suction side 8, piston bridge 3 has a single-layer design, so that, by economizing on material, a weight reduction is achieved.

Also discernible in FIG. 1 is that inner shell 6 and—in any case, on pressure side 5—also outer shell 7 have outwardly stamped or bent regions on opposite sides to form a pressure cup 9 and a suction cup 10. Together, pressure cup 9 and suction cup 10 are used for accommodating sliding shoes 4 and thus for sliding engagement for annular disk 2.

As already previously explained, the region of suction cup 10 has a single-layer design, namely due to only inner shell 6 being provided there. On the opposite side, for example, on pressure side 5, pressure cup 9 is formed by two layers, namely both by inner shell 6, as well as by outer shell 7, in order, namely, to be able to absorb forces in this way.

In addition, FIG. 1 clearly shows that, in side surface 11, in inner shell 6, a recess 12 in the form of a stamped-out formation is provided, which enlarges the space within piston bridge 3 and thus the clearance space for annular disk 2 and/or sliding shoes 4. By employing this measure, there is no need to expand the space within piston bridge 3 by an outwardly directed stamping which would entail the disadvantage of a radial expansion of piston bridge 3.

In addition, FIG. 1 shows that piston 1 is designed as a sleeve that is closed at the extremity by outer shell 7 of piston bridge 3. The connection between piston 1 and outer shell 7 of piston 1 is produced by welding.

In a schematic view, FIG. 2 shows a second exemplary embodiment of a piston bridge 3 without piston 1 in the selected illustration. Moreover, further details are not provided, especially as it is merely a question of the configuration between inner shell 6 and outer shell 7.

Specifically, inner shell 6 has punctiform or linear raised parts 13 which extend in the direction of outer shell 7. These raised parts 13, which, for example, may be pre-stamped, form what are generally referred to as flow sites for the resistance welding, thereby facilitating this joining technique.

Moreover, the present invention encompasses a reciprocating piston machine, as is known, for example, from the German Patent DE 197 49 727 C2. However, in this case, it is equipped with a device in accordance with the above explanations.

Finally, it is noted that the exemplary embodiments discussed above are merely intended to illustrate the claimed teaching, but not to limit it to such embodiments.

LIST OF REFERENCE NUMERALS

1 piston
2 annular disk
3 piston bridge
4 sliding shoe (of the annular disk)
5 pressure side (of the piston bridge)
6 inner shell
7 outer shell
8 suction side (of the piston bridge)
9 pressure cup
10 suction cup
11 side surface
12 recess
13 raised part (on the inner shell)

The invention claimed is:

1. A device for coupling a piston to an annular disk, comprising a piston bridge assigned to the piston and sliding shoes assigned to the annular disk, the piston bridge at least partially embracing, respectively overlapping the annular disk and engaging slidingly via the sliding shoes with the annular disk, wherein the piston bridge has at least two layers at least on the side facing the piston.

2. The device as recited in claim 1 wherein the piston is coupled to a swash/wobble plate or to a swash ring of a power unit of a reciprocating piston machine.

3. The device as recited in claim 1 wherein the reciprocating piston machine is a compressor of an air conditioning system of a motor vehicle.

4. The device as recited in claim 1 wherein the material of the piston bridge is a two-layer sheet metal.

5. The device as recited in claim 1 wherein the material of the piston bridge is a three- or multi-layer sheet metal.

6. The device as recited in claim 1 wherein the piston bridge includes an inner shell and an outer shell, the inner shell being in sliding engagement with the sliding shoes, the outer shell connecting the inner shell to the piston.

7. The device as recited in claim 6 wherein one or more intermediate shells is between the inner shell and the outer shell, and the intermediate shells designed as partial shells or as complete shells.

8. The device as recited in claim 6 wherein the outer shell extends from a side facing the piston over a side surface up to or over a side of the piston bridge facing away from the piston.

9. The device as recited in claim 6 wherein the inner shell and the outer shell are on opposite sides having outwardly stamped or bent regions foaming a pressure cup and a suction cup, the pressure cup and the suction cup accommodating the sliding shoes.

10. The device as recited in claim 9 wherein the region of the suction cup has a single-layer design, the suction cup being formed by the inner shell.

11. The device as recited in claim 6 wherein the inner shell has a recess enlarging the space within the piston bridge and a clearance space for the annular disk and/or the sliding shoes.

12. The device as recited in claim 11 wherein the recess is in the side surface of the inner shell.

13. The device as recited in claim 11 wherein the recess is a stamped out formation.

14. The device as recited in claim 6 wherein the inner and outer shells are joined by bonding.

15. The device as recited in claim 6 wherein the inner and outer shells are joined by rivets.

16. The device as recited in claim 6 wherein the inner and outer shells are joined by welding.

17. The device as recited in claim 6 wherein one of the shells to be joined has punctiform or linear raised parts facilitating the resistance welding relative to the opposite shell.

18. The device as recited in claim 17 wherein the inner shell has the punctiform or linear raised parts.

19. The device as recited in claim 17 wherein the punctiform or linear raised parts are stamped.

20. The device as recited in claim 6 wherein the piston bridge is welded via its outer shell to the piston.

21. The device as recited in claim 1 wherein the piston is a hollow body sleeve that is closed at the extremity.

22. A reciprocating piston machine comprising a device for coupling a piston to an annular disk as recited in claim 1.

23. The reciprocating piston machine as recited in claim 22 wherein the reciprocating piston machine is a compressor of an air conditioning system of a motor vehicle.

24. The reciprocating piston machine as recited in claim 22 wherein the annular disk is a swash/wobble plate or a swash ring of a power unit of the reciprocating piston machine.

* * * * *